US007119748B2

(12) United States Patent
Autti

(10) Patent No.: US 7,119,748 B2
(45) Date of Patent: Oct. 10, 2006

(54) INTERNAL MULTI-BAND ANTENNA WITH PLANAR STRIP ELEMENTS

(75) Inventor: Marko Autti, Oulu (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/027,025

(22) Filed: Dec. 31, 2004

(65) Prior Publication Data

US 2006/0145923 A1 Jul. 6, 2006

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 6,140,966 | A | 10/2000 | Pankinaho | 343/700 |
| 6,380,905 | B1 | 4/2002 | Annamaa et al. | 343/767 |
| 6,407,715 | B1 | 6/2002 | Chen | 343/767 |
| 6,408,190 | B1 | 6/2002 | Ying | 455/553 |
| 6,552,686 | B1 | 4/2003 | Ollikainen et al. | 343/700 |
| 6,650,294 | B1 * | 11/2003 | Ying et al. | 343/700 MS |
| 6,734,825 | B1 * | 5/2004 | Guo et al. | 343/700 MS |
| 6,741,214 | B1 * | 5/2004 | Kadambi et al. | 343/700 MS |
| 6,982,675 | B1 * | 1/2006 | Kwak et al. | 343/702 |

FOREIGN PATENT DOCUMENTS

| | | |
|---|---|---|
| EP | 0 757 405 A1 | 2/1997 |
| EP | 0 997 974 A1 | 5/2000 |

OTHER PUBLICATIONS

IEEE; Z. Liu et al.; "Dual-Frequency Planar Inverted-F Antenna"; IEEE Transactions on Antennas and Propagation, vol. 45, No. 10; pp. 1451-1458; Oct. 1997.

IEEE; P. Song et al.; "Triple-Band Planar Inverted F Antenna"; IEEE 0-7803-5639-X/99; 1999.

European Space Agency; J. Ollikainen et al.; "Internal Dual-band Patch Antenna for Mobile Phones"; Proceedings AP2000 Millennium Conference on Antennas and Propagation presented at Davos, Switzerland, Apr. 9-14, 2000.

* cited by examiner

*Primary Examiner*—Tho Phan
(74) *Attorney, Agent, or Firm*—Ware, Fressola Van Der Sluys & Adolphson LLP

(57) ABSTRACT

An antenna module for use in a small communications device. The antenna module comprises a dielectric block disposed on a circuit board having a ground plane, an elongated planar strip element folded to fit on different surfaces of the dielectric block, and one or more parasitic element disposed adjacent to the antenna element. In particular, the antenna element is designed to produce resonance frequencies at GSM850 and E-GSM900 bands (the lower bands) and one resonance for the GSM1800/GSM1900/WCDMA2100 bands (the upper bands). The dielectric block can be made of soft or hard plastic.

21 Claims, 10 Drawing Sheets

INTERNAL MULTI-BAND ANTENNA WITH PLANAR STRIP ELEMENTS

FIELD OF THE INVENTION

The present invention relates generally to a radio antenna and, more specifically, to an internal multi-band antenna for use in a hand-held telecommunication device, such as a mobile phone.

BACKGROUND OF THE INVENTION

The development of small antennas for mobile phones has recently received much attention due to size reduction of the handsets, requirements to keep the amount of radio-frequency (RF) power absorbed by a user below a certain level regardless of the handset size, and introduction of multi-mode phones. It would be advantageous, desirable and even necessary to provide internal multi-band antennas to be disposed inside a handset body, and these antennas should be capable of operating in multiple band systems such as GSM850 (824 MHz–894 MHz) E-GMS900 (880 MHz–960 MHz), GSM1800 (1710 MHz–1880 MHz), and PCS1900 (1850 MHz–1990 MHz). Shorted patch antennas, or planar inverted-F antennas (PIFAs), have been used to provide two or more resonance frequencies. For example, Liu et al. (Dual-frequency planar inverted-F antenna, IEEE Transaction on Antennas and Propagation, Vol.45, No.10, October 1997, pp. 1451–1458) discloses a dual-band PIFA; Pankinaho (U.S. Pat. No. 6,140,966) discloses a double-resonance antenna structure for several frequency ranges, which can be used as an internal antenna for a mobile phone; Isohatala et al. (EP 0997 970 A1) discloses a planar antenna having a relatively low specific absorption rate (SAR) value; Ollikainen et al. "Internal Dual-band Patch Antenna for Mobile Phones, Proceedings AP2000 Millennium Conference on Antennas and Propagation" presented at Davos, Switzerland, Apr. 9–14, 2000, discloses a PIFA having resonance frequencies at E-GSM900, GSM1800 and PCS1900 bands, wherein one of the shorted patches is folded to provide a capacitive load to the E-GSM900 shorted patch; and Song et al. (Triple-band planar inverted-F antenna, IEEE Antennas and Propagation International Symposium Digest, Vol.2, Orlando, Fla., Jul. 11–16, 1999, pp. 908–911) discloses a triple-band PIFA.

Currently, quad-band (GSM 850/900/1800/1900) engines are already available for mobile phones, but the antenna is still an issue because it is one of the largest parts in a mobile phone. In order to fit more antenna elements with acceptable performance in the available space, there is an ongoing effort to reduce their physical size. With the constraints in physical size, existing internal multi-band antennas do not cover all of the GSM850, GSM900, GSM1800 and GSM1900 bands.

SUMMARY OF THE INVENTION

It is the primary objective of the present invention to provide a quad-band antenna of a small size so it can be used in a small communications device such as a mobile phone. This objective can be achieved by folding a radiative element made from an elongated planar strip of electrically conductive material into different segments and by arranging the segments in a certain way to produce third harmonics in the resonance frequencies.

Thus, the first aspect of the present invention provides a multiband antenna for use in a communications device operable in a first frequency range and a second frequency range, the second frequency range having higher frequencies two to three times the frequencies in the first frequency range, the communications device having a ground plane. The antenna comprises:

a radiative element made substantially of an elongated strip of electrically conductive material, the strip having a first end and a second end, wherein the elongated strip has a first section adjacent to the first end and a second section adjacent to the second end electrically connected to the first section;

a feeding point electrically connected to the first end of the radiative element;

a grounding point adjacent to the feeding point, for electrically connecting the first end of radiative element to the ground plane; and a further radiative element having an elongated segment made of electrically conductive material, and a grounding segment electrically connected the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section is substantially parallel to the first section so that the placement of the second section relative to the first section together with the placement of the elongated segment of the further radiative element relative to the elongated strip provides resonance frequencies in the second frequency range.

According to the present invention, the first frequency range is substantially between 750 MHz and 1000 MHz, and the second frequency range is substantially between 1700 MHz and 2200 MHz. However the first frequency range can be and the second frequency range can be different from those ranges mentioned-above, depending on the dimensions of the radiative element.

According to the present invention, the first section is located on a first plane and a second section, the second section is located on a second plane different from the first plane.

According to the present invention, the first plane is substantially perpendicular to the second plane. However, it is possible that the first section and the second section are located on different parts of a curved surface.

According to the present invention, the length is substantially in the range of 60 mm to 80 mm.

The second aspect of the present invention provides an antenna module for use in a communications device operable in a first frequency range and a second frequency range, the second frequency range having higher frequencies two to three times the frequencies in the first frequency range, the communications device having a circuit board and a ground plane, said antenna module comprising:

a support body disposed on the circuit board, the support body has at least a first surface and a second surface, the first surface located on a first plane and a second surface located on a second plane different from the first plane; and an antenna disposed on the support body, the antenna comprising:

- a radiative element made substantially of an elongated strip of electrically conductive material, the strip having a first end and a second end, wherein the elongated strip has first section adjacent to the first end and a second section adjacent to the second end electrically connected to the first section;
- a feeding point electrically connected to the first end of the radiative element;

a grounding point adjacent to the feeding point, for electrically connecting the first end of the radiative element to the ground plane, and a further radiative element having an elongated segment made of electrically conductive material, and a grounding segment electrically connecting the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section is substantially parallel to the first section so that the placement of the second section relative to the first section together with the placement of the elongated segment of the further radiative element relative to the elongated strip provides resonance frequencies in the second frequency range.

According to the present invention, the first frequency range is substantially between 750 MHz and 1000 MHz, and the second frequency range is substantially between 1700 MHz and 2200 MHz. However, the first frequency range and the second frequency range are different from the above-mentioned ranges, depending on the dimensions of the radiative element and the material of the support body.

According to the present invention, the first section located on a first plane and a second section, the second section located on a second plane different from the first plane, and the first plane is substantially perpendicular to the second plane.

According to the present invention, the length is substantially in the range of 60 mm to 80 mm and the support block is made substantially of plastic, wherein the first section is located on the first surface of the support body and a second section located on a second surface of the support body.

According to the present invention, the elongated strip further has an intermediate section disposed between the first section and the second section, and the intermediate section is located on the first surface of the support body.

According to the present invention, the elongated strip further has an intermediate section disposed between the first section and the second section, and the intermediate section is located on the second surface of the support body.

According to the present invention, the elongated strip further has an intermediate section disposed between the first section and the second section, the intermediate section having a first segment adjacent to the first section and a second segment adjacent to the second section, and wherein the first segment is located on the first surface and the second segment is located on the second surface.

According to the present invention, the first surface is substantially parallel to the ground plane and the second surface is substantially perpendicular to the ground plane.

According to the present invention, the antenna module further comprises another radiative element having an elongated segment made of electrically conductive material, and a grounding segment electrically connecting the elongated segment to the ground plane, wherein the elongated segment of said another radiative element is disposed between the radiative element and the further radiative element for providing further resonance frequencies in the second frequency range.

Alternatively, the support body has a curved surface, and the first and second sections of the radiative element are located on different parts of the curved surface.

According to the present invention, the support body is made of a dielectric material, such as plastic, ceramic and the like.

The third aspect of the present invention provides a communications device operable in a first frequency range and a second frequency range, the second frequency range having higher frequencies two to three times the frequencies in the first frequency range, said communications device comprising:

a housing;

a circuit board having a ground plane located in the housing; and an antenna module, the antenna module comprising:

a support body disposed on the circuit board, the support body has at least a first surface and a second surface, the first surface located on a first plane and a second surface located on a second plane different from the first plane;

a radiative element made substantially of an elongated strip of electrically conductive material disposed on the support body, the strip having a first end and a second end, wherein the elongated strip has a first section adjacent to the first end and a second section adjacent to the second end electrically connected to the first section;

a feeding point electrically connected to the first end of the radiative element;

a grounding point adjacent to the feeding point, for electrically connecting the first end of the radiative element to the ground plane, and a further radiative element having an elongated segment made of electrically conductive material, and a grounding segment electrically connecting the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section is substantially parallel to the first section so that the placement of the second section relative to the first section together with the placement of the elongated segment of the further radiative element relative to the elongated strip provides resonance frequencies in the second frequency range.

It is possible that the support body has a curved surface, and the first surface and the second surface are different parts of the curved surface.

According to the present invention, the communications device can be a mobile terminal, a PDA, a communicator or any small electronic device that requires a quad-band antenna.

The present invention will become apparent upon reading the description taken in conjunction with FIGS. 1*a* to 5.

DETAILED DESCRIPTION OF THE INVENTION

The present invention provides an internal multi-band antenna which has one resonance for the GSM850 and E-GSM900 bands (the lower bands) and one resonance for the GSM1800/GSM1900/WCDMA2100 bands (the upper bands). However, the present invention is also applicable to other internal multi-band antenna having different lower bands and upper bands.

Figure 1A:
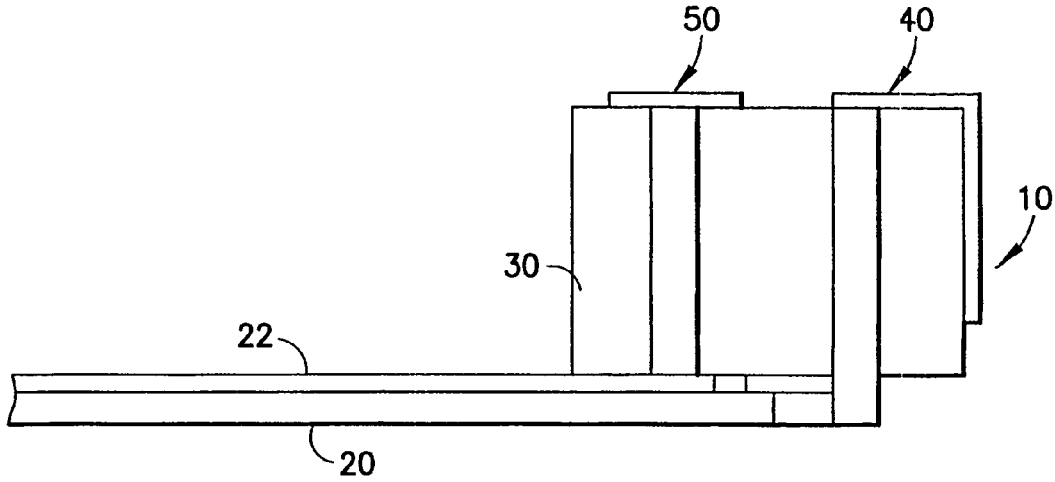
FIG. 1*a* is a schematic representation showing a side-view of the internal multi-band antenna, according to one embodiment of the present invention.
Figure 1B:
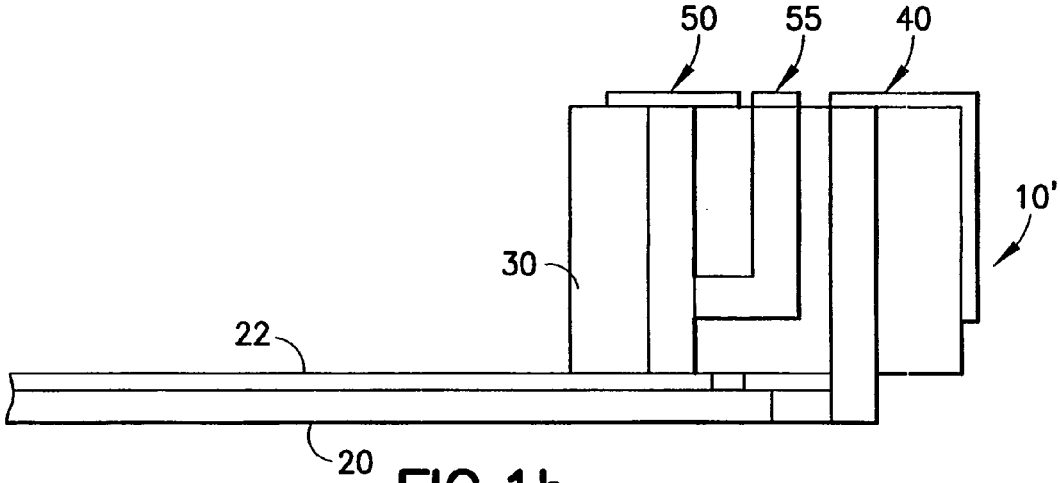
FIG. 1*b* is a schematic representation showing a side-view of the internal multi-band antenna, according to another embodiment of the present invention.

FIG. 1*a* shows the internal multi-band antenna, according to one embodiment of the present invention. As shown in FIG. 1*a*, antenna 10 has an antenna element 40 and a parasitic element 50 disposed on a dielectric support block 30. The block 30 is mounted on a circuit board 20, such as a printed-circuit board (PCB) having a ground plane 22. FIG. 1*b* shows another embodiment of the present invention. As shown in FIG. 1*b*, the antenna 10' has two parasitic elements 50 and 55.

Figure 1C:
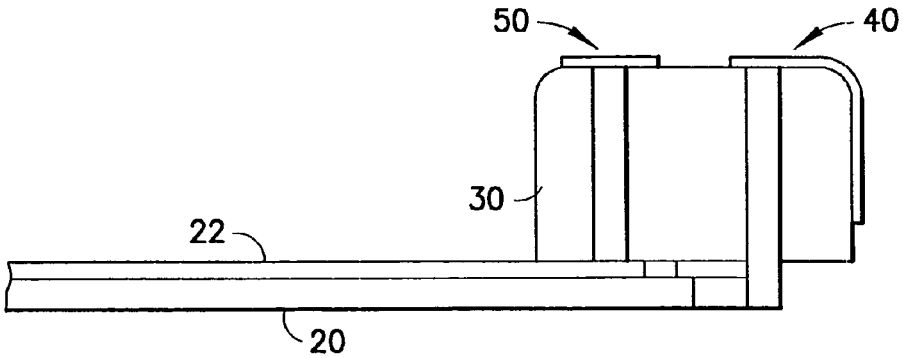
FIG. 1*c* is a schematic representation showing a side-view of the internal multi-band antenna, wherein the upper corners of the support body are rounded.
Figures 1D, 2E:
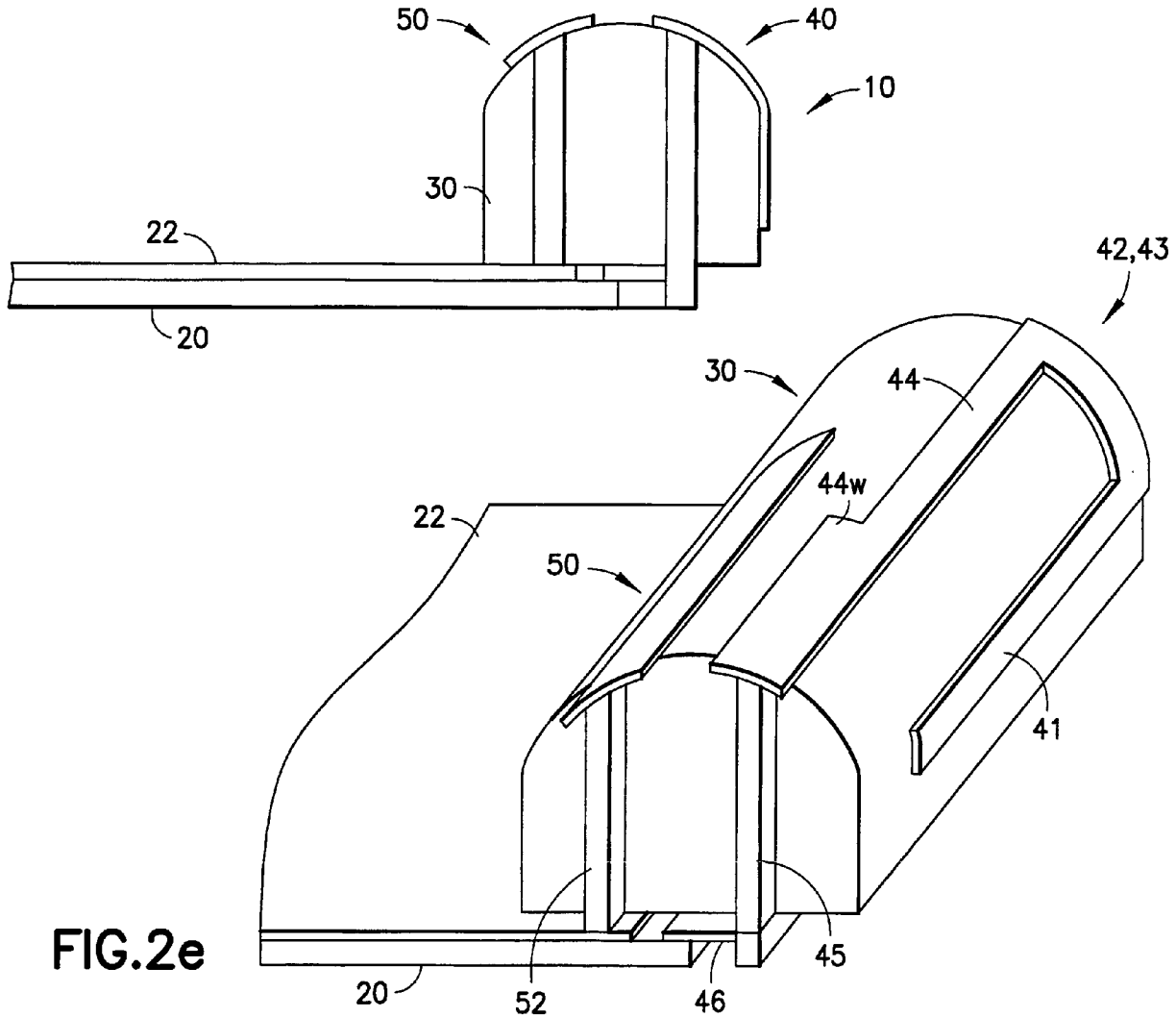
FIG. 1*d* is a schematic representation showing a side-view of the internal multi-band antenna, wherein the support body has a curved surface.
FIG. 2*e* is an isometric view of the internal multi-band antenna, wherein the support body has a curved upper surface.

Furthermore, it is possible that one or two of upper corners of the block 30 are rounded, as shown in FIG. 1*c*. Alternatively, the upper surface of the block 30 is a curved surface, as shown in FIG. 1*d*.

Figure 2A:
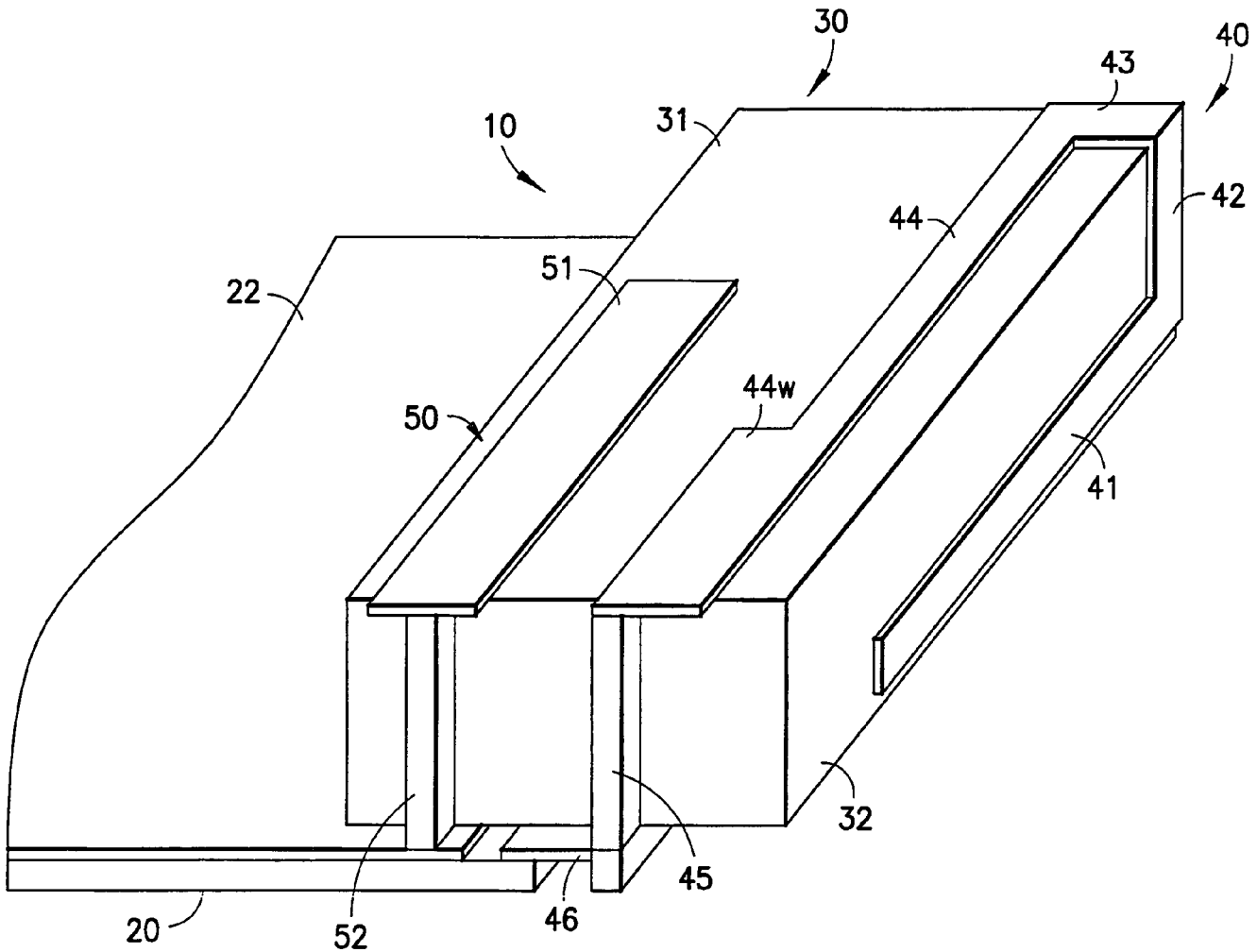
FIG. 2*a* is an isometric view of the internal multi-band antenna of FIG. 1*a*.
Figure 3A:
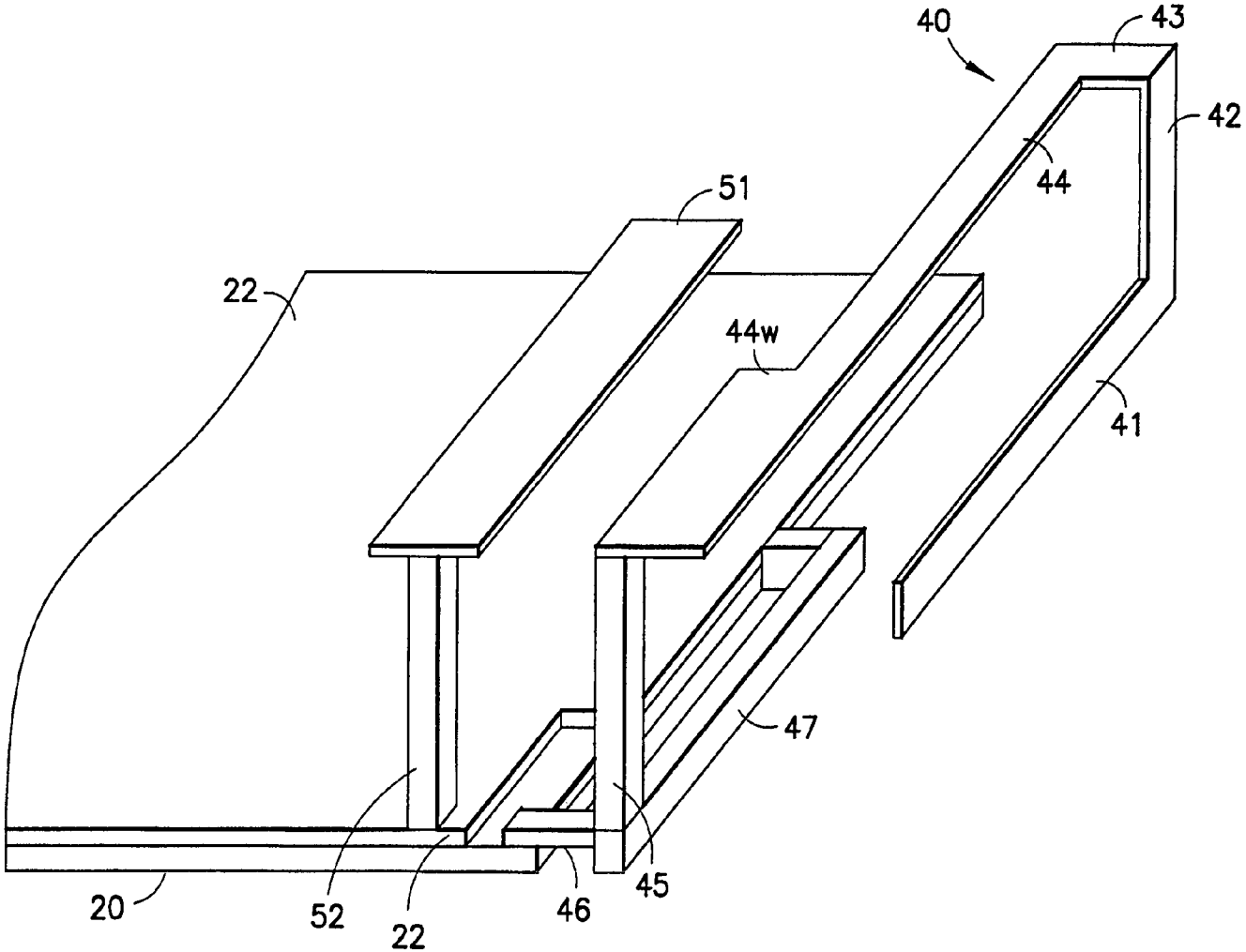
FIG. 3*a* is an isometric view of the internal multi-band antenna of FIG. 2*a*, without the support block.

FIG. 2*a* shows an isometric view of the internal multi-band antenna of FIG. 1*a*. As shown, the upper surface 31 of the dielectric block 30 is substantially parallel to the ground plane and the front surface 32 is substantially perpendicular to the upper surface 31. The antenna element 40 is substantially a planar strip of electrically conductive material folded and bent into a plurality of segments: 41, 42, 43 and 44, with an end section 45 electrically connecting segment 44 to a feed 46 and a grounding segment 47. FIG. 3*a* shows the same multi-band antenna without the dielectric block 30. As can be seen from FIG. 3*a*, the grounding segment 47 is electrically connected to the ground plane 22. In order to produce a resonance at the lower bands (central frequencies substantially at 850 MHz and 900 MHz), the total length of segments 41, 42, 43, 44 and 45 is about 60–80 mm if the block 30 is made of plastic. Depending on the material of the dielectric block, the total length can be smaller than 60 mm or greater than 80 mm. For example, if the dielectric block 30 is made of ceramic, the total length of the antenna element 40 may be different. The plastic can be hard, soft or even flexible, but the dielectric block 30 must be sufficiently rigid to keep the antenna element 40 and the parasitic element 50 (also parasitic element 55 in FIG. 3*b*) in a substantially fixed distance. The total length of these segments depends on the electrical environment surrounding the segments. The upper resonance is a third harmonic resonance which is tuned downward by placing section 41 and 44 on the plane of surface 32 with the open end of segment 40 located close to segment 44. In general, RF currents are high in segment 44 near the feeding point, it is advantageous to widen the end 44*w* of segment 44 if it is necessary and feasible.

As shown in FIGS. 2*a* and 3*a*, the parasitic element 50 has a planar strip 51 of electrically conductive material disposed parallel to and spaced from segment 44 and a grounding segment 52 electrically connecting the planar strip 51 to the ground plane 22. The length of the planar strip 51 is between 15 to 30 mm, depending on the width of the strip 51, and the separation between the planar strip 51 and segment 44*w* of the antenna element is 5 mm. The parasitic segments 51 and 52 give additional resonance for the upper bands.

Figure 2B:
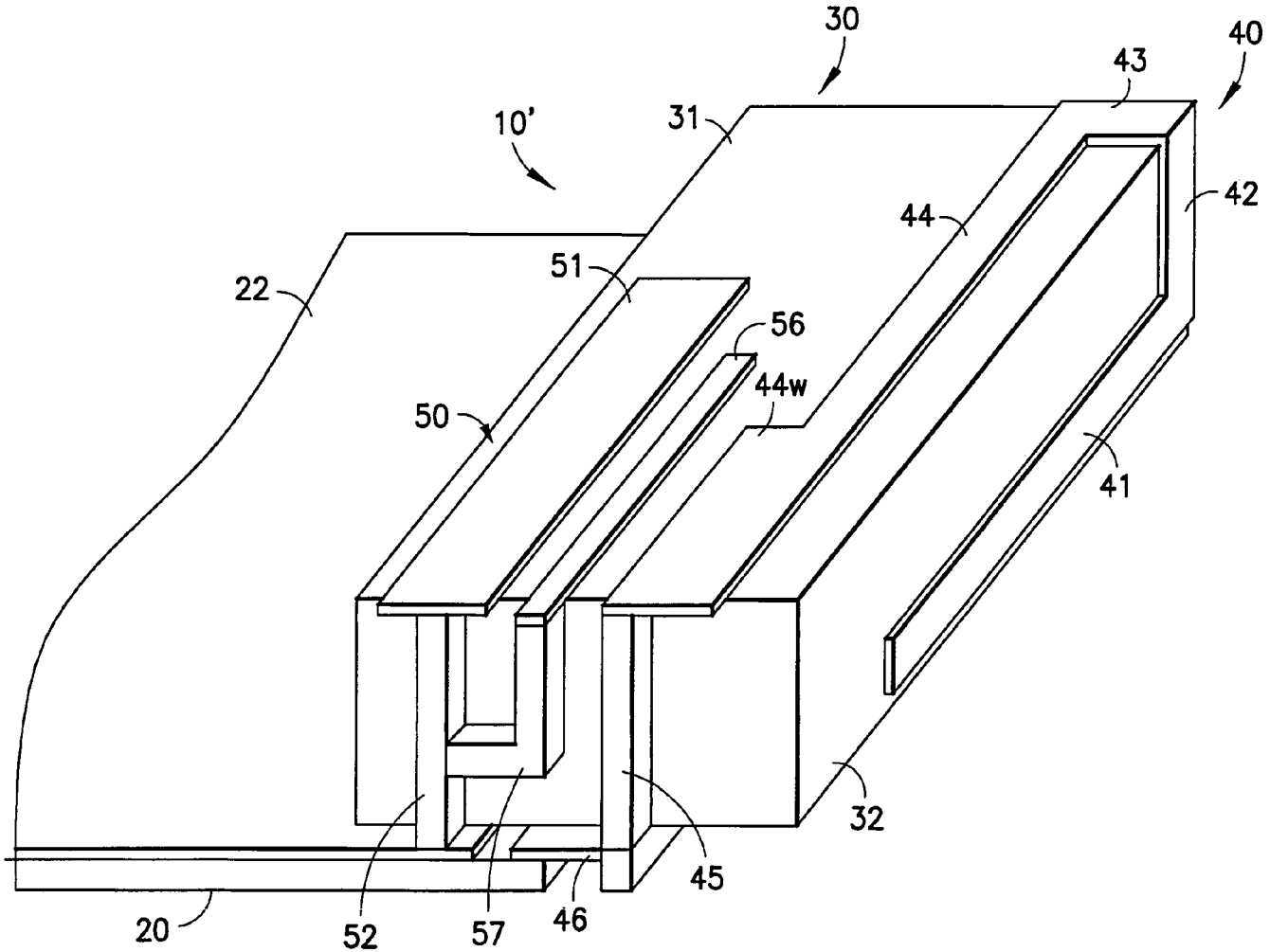
FIG. 2*b* is an isometric view of the internal multi-band antenna of FIG. 1*b*.
Figure 3B:
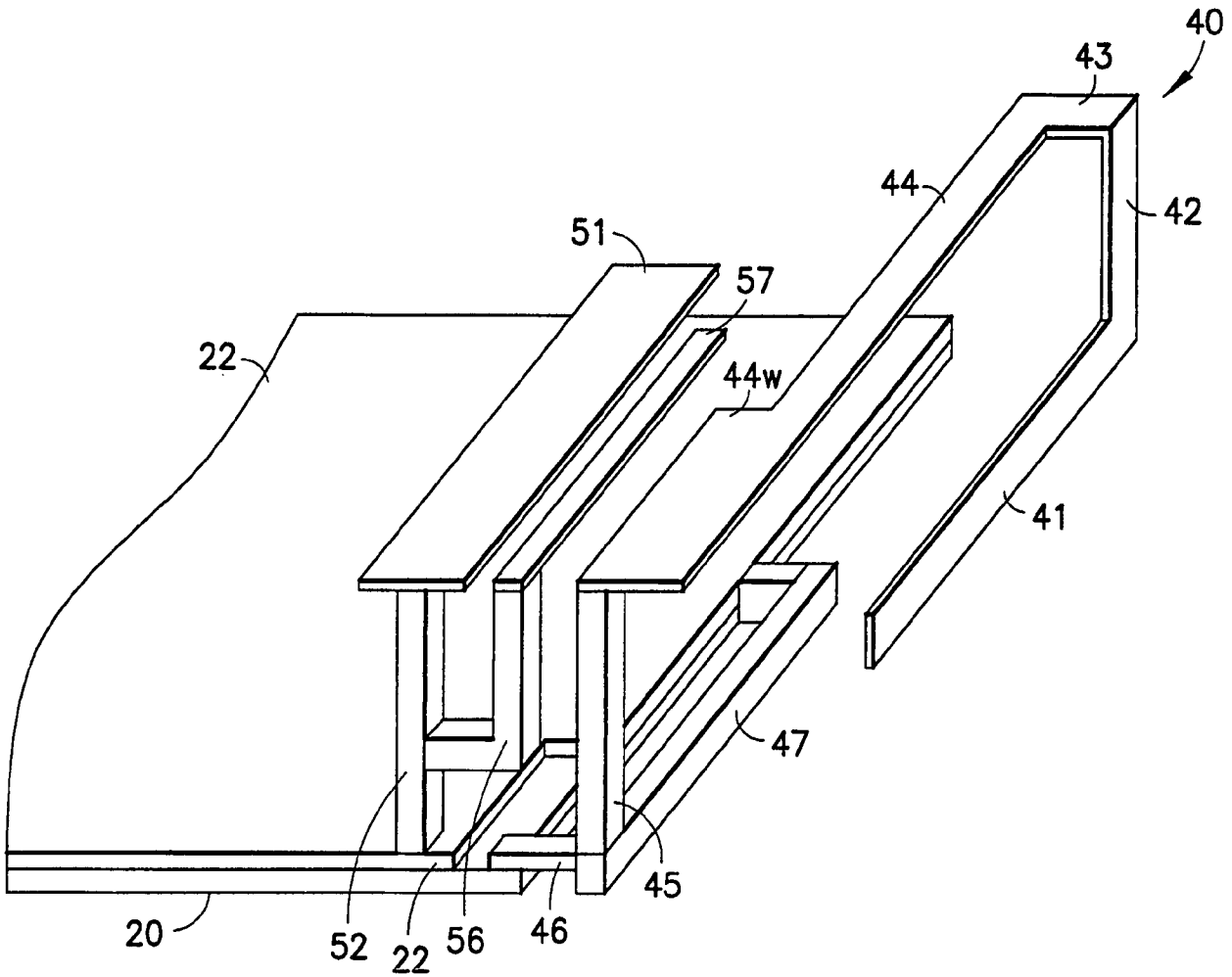
FIG. 3*b* is an isometric view of the internal multi-band antenna of FIG. 2*b*, without the support block.

It is possible to add one or more parasitic elements to the multi-band antenna in order to produce additional resonances. For example, a second parasite element 55 is disposed adjacent to the parasitic element 50 for providing an extra resonance to the upper bands, as shown in FIGS. 2*b* and 3*b*. As shown in FIGS. 2*b* and 3*b*, the second parasitic element 55 has a planar strip 56 and a grounding segment 57 connecting the planar strip 56 to the ground plane 22 via the grounding segment 52 of the first parasitic element 50. It is also possible that the grounding segment 57 is directly connected to the ground plane 22, as shown in FIG. 3*c*.

Figure 2C:
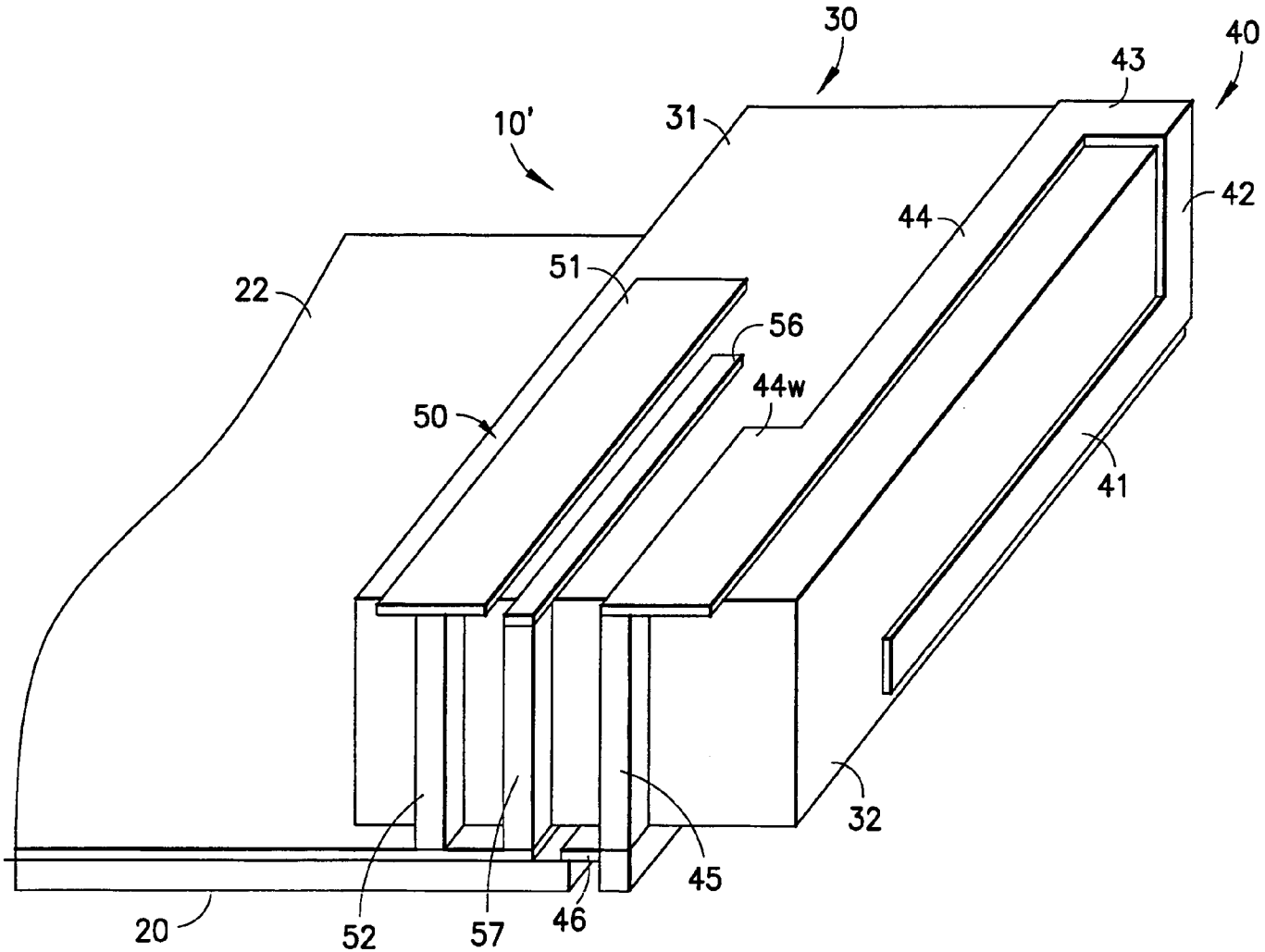
FIG. 2*c* is an isometric view of the internal multi-band antenna, according to yet another embodiment of the present invention.
Figure 2D:
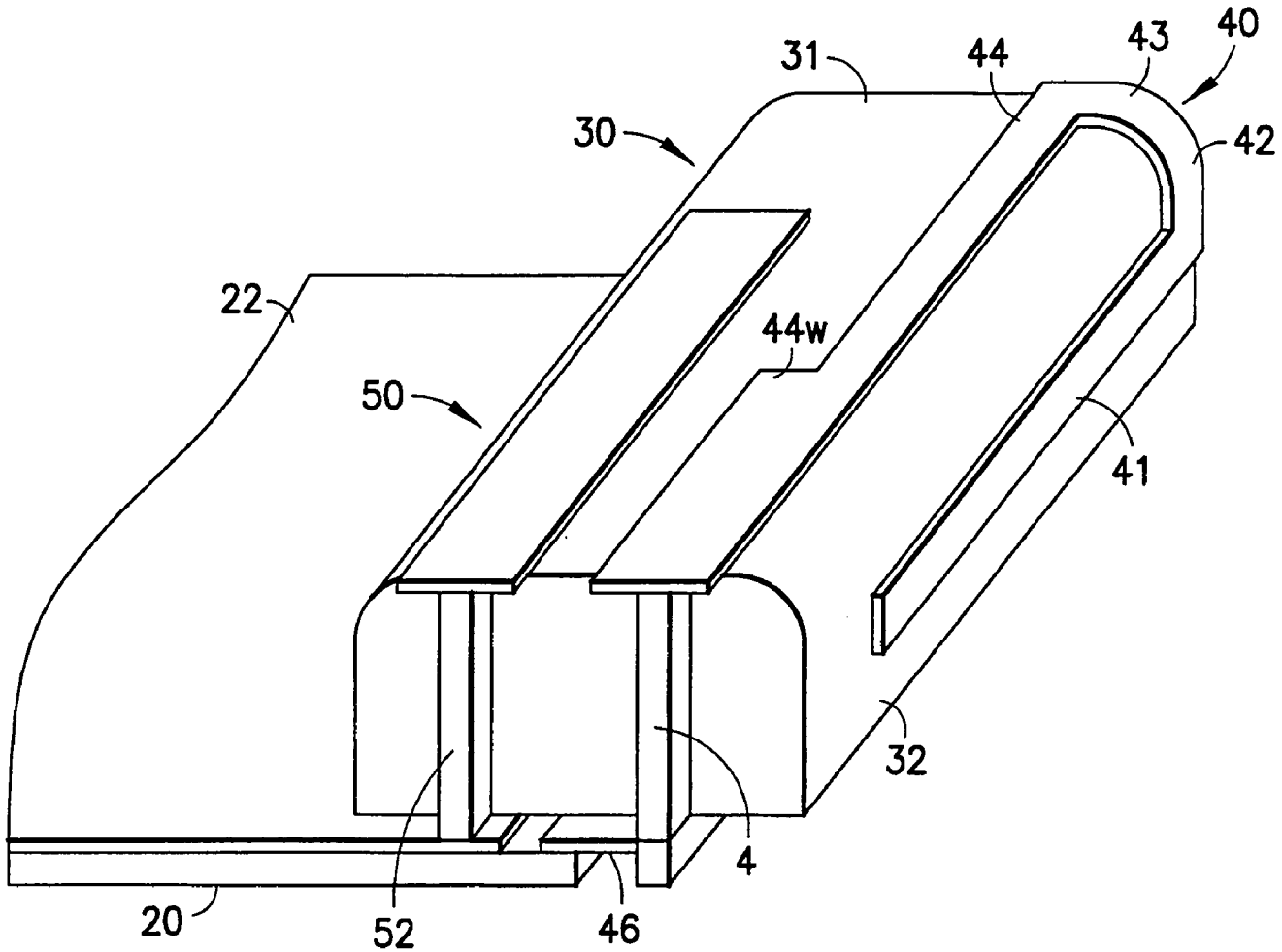
FIG. 2*d* is an isometric view of the internal multi-band antenna, wherein the support body has two rounded upper corners.

When the dielectric block 30 is rectangular as shown in FIGS. 2*a*–2*c*, segment 42 and segment 43 are located on different surfaces 32, 31 of the dielectric block 30. However, when one or two upper corners of the dielectric block 30 are rounded, as shown in FIGS. 1*c* and 2*d*, segment 42 is gradually curved into segment 43. As shown in FIG. 2*d*, segment 41 and segment 44 are located at different planes and the planes are substantially perpendicular to each other. When the upper surface of the block 30 is curved as shown in FIGS. 1*d* and 2*e*, segment 41 and segment 44 are located on different parts of the curved upper surface.

Figure 4:
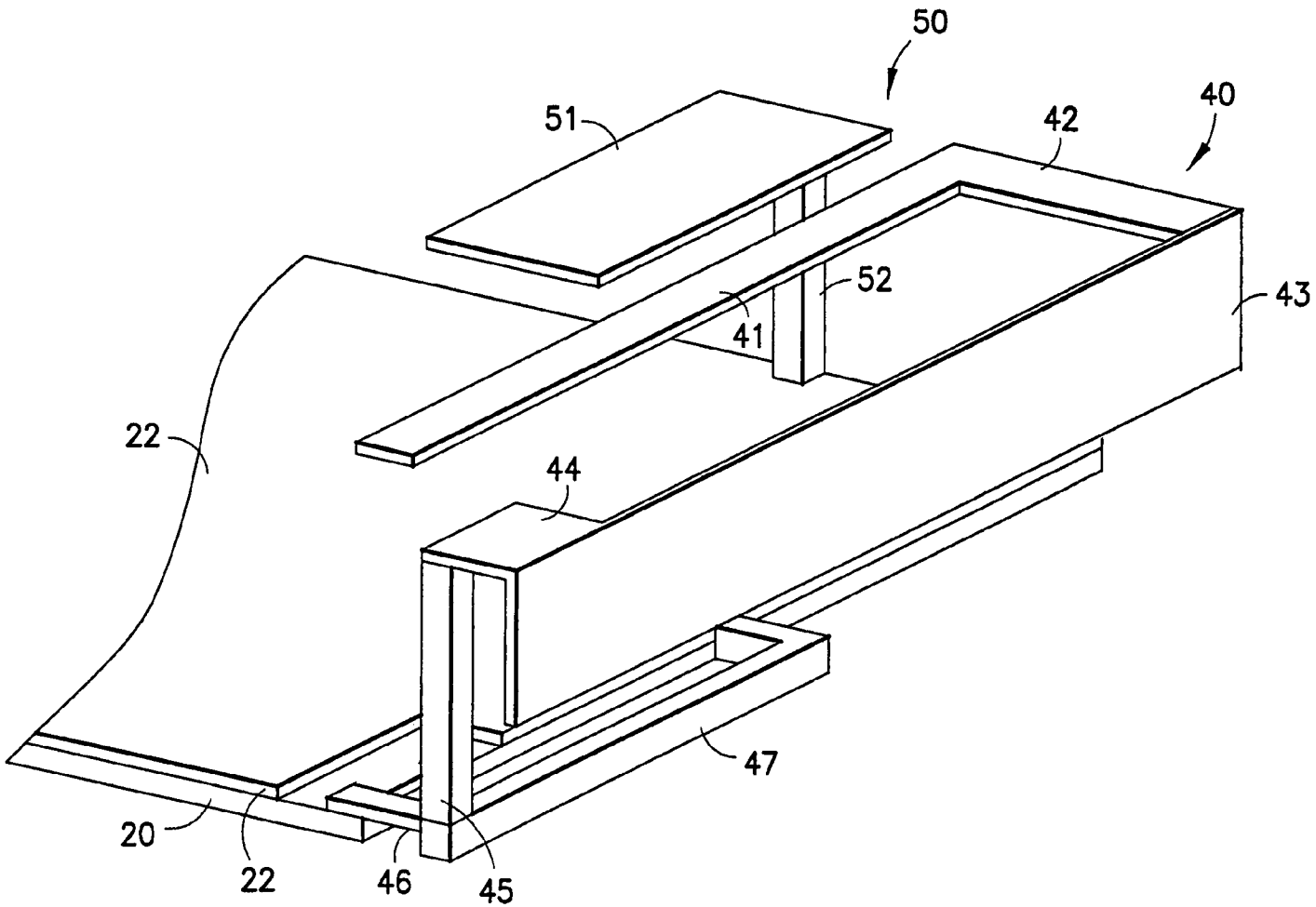
FIG. 4 is an isometric view of the internal multi-band antenna, according to a different embodiment of the present invention.

It should be appreciated that the multi-band antenna, according to the present invention, can be used in a space-limited device such as a small communication device, such as a mobile phone, a communicator and a personal digital assistant (PDA). In particular, the lower bands of the antenna include resonance frequencies about 750 MHz to 1000 MHz, thus the total length of the antenna element 40 is about 80 mm, depending on the dielectric loading. In order to fit the multi-band antenna into a small device, it is necessary to fold or bend the antenna element 40 into connecting segments. Furthermore, in order to produce the upper bands including resonance frequency about 1700 MHz to 2200 MHz, it is necessary to arrange the segments in a certain way so as to produce third harmonics in the resonance frequencies. For example, the open-end segment 41 is arranged to be substantially parallel to the segment 44. However, the antenna element 40 (of a fixed length) can be folded or bent in many different ways so long as the electrical coupling between certain segments is sufficient to provide the resonance in the upper bands. Moreover, it is advantageous to have a dielectric block 30 that is rectangular so that the planar strip can be made to fit onto different surfaces of the block. FIG. 4 shows another arrangement of the antenna segments. As shown in FIG. 4, the open-end segment 41 is now located closer to the parasitic element 50 and its surface is substantially parallel to the ground plane 22. The segment 44 is located beyond the circuit board 20 and the surface of the segment 44 is substantially perpendicular to the ground plane 22. However, while the arrangement of the antenna segments as shown in FIG. 4 provides a possible solution, frequency tuning using parasitic 51, 52 may not be as effective as the arrangements shown in FIGS. 2*a* and 2*b*.

It should be appreciated, however, that all of the segments 41 to 44 can be co-located on the same plane if there is sufficient space to accommodate the entire antenna element 40. Furthermore, two or more parasitic elements, such as those shown in FIGS. 2*b* and 2*c*, can be placed adjacent to the antenna element 40 for tuning.

Figure 5:
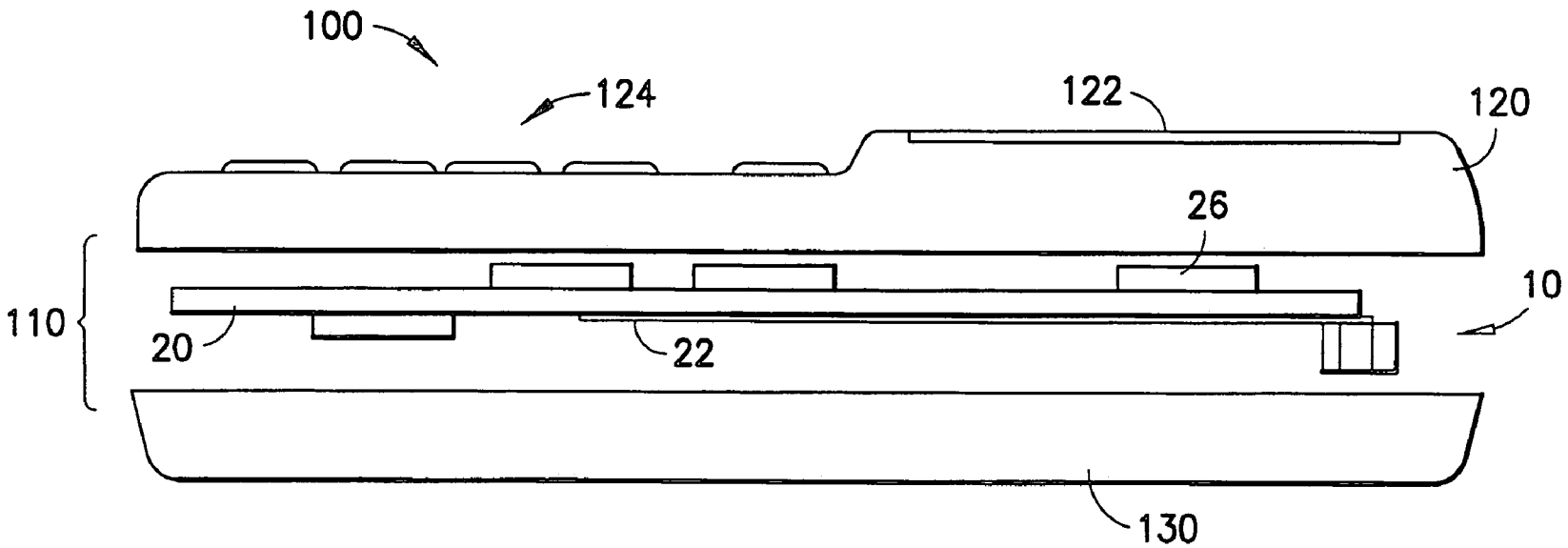
FIG. 5 is a schematic representation showing a mobile phone having the internal multi-band antenna, according to the present invention.

FIG. 5 is a schematic representation showing a hand-held telecommunications device, such as a mobile terminal, that has the internal multi-band antenna, according to the present invention. As shown, the mobile terminal 100 has a housing 110 to accommodate various electrical components such as a RF front-end 26, a display 122 and a keyboard 124. The housing 110 comprises an upper housing part 120 and a lower housing part 130 to enclose the PCB 20 having the quad-band antenna 10 of the present invention.

It should be appreciated by persons skilled in the art that the antenna module including the antenna 10, the circuit board 20 and the ground plane 22 can be arrangement differently. For example, the ground plane 22 can be disposed on one side of the circuit board 20 and the antenna 10 is disposed on the other side. The antenna 10 can also be facing the upper housing part 120. Furthermore, the circuit board 20 can also be a printed wiring board (PWB) or a flexible substrate so long as the dielectric block 30 is sufficiently rigid.

It should also be appreciated that, as shown in FIGS. 3*a*, 3*b* and 4, the feed 46 and the grounding connection 47 are both located on one end of the radiative element 40, adjacent to each other. Such a grounding connection acts like an inductive stub for the radiative element 40. This stub compensates for the capactive effect, which arises mainly when the radiative element 40 is located close to the ground plane 22 and some of folded segments of the radiative element are parallel to the ground plane 22. In a monopole antenna, the feed is usually located at a distance from the grounding connection. A monopole antenna is more affected by this capacitive environment in a folded arrangement.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A multiband antenna for use in a communications device operable in a first frequency range and a second frequency range, the second frequency range having higher frequencies two to three times the frequencies in the first frequency range, the communications device having a ground plane, said antenna comprising:

a radiative element made substantially of an elongated strip of electrically conductive material, the strip having a first end and a second end, wherein the elongated strip has a first section adjacent to the first end and a second section adjacent to the second end electrically connected to the first section;

a feeding point electrically connected to the first end of the radiative element;

a grounding point adjacent to the feeding point, for electrically connecting the first end of the radiative element to the ground plane; and a further radiative element having an elongated segment made of electrically conductive material, and a grounding segment electrically connecting the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section and the first section lie in axes substantially parallel to one another so that the placement of the second section relative to the first section together with the placement of the elongated segment of the further radiative element relative to the elongated strip provides resonance frequencies in the second frequency range.

2. The antenna of claim 1, wherein the first frequency range is substantially between 750 MHz and 1000 MHz, and the second frequency range is substantially between 1700 MHz and 2200 MHz.

3. The antenna of claim 2, wherein the length is substantially in the range of 60 mm to 80 mm.

4. The antenna of claim 1, wherein the first section is located on a first plane and the second section is located on a second plane different from the first plane.

5. The antenna of claim 4, wherein the first plane is substantially perpendicular to the second plane.

6. An antenna module for use in a communications device operable in a first frequency range and a second frequency range, the second frequency range having higher frequencies two to three times the frequencies in the first frequency range, the communications device having a circuit board and a ground plane, said antenna module comprising:

a support body disposed on the circuit board; and an antenna disposed on the support body, the antenna comprising:

a radiative element made substantially of an elongated strip of electrically conductive material, the strip having a first end and a second end, wherein the elongated strip has a first section adjacent to the first end and a second section adjacent to the second end electrically connected to the first section;

a feeding point electrically connected to the first end of the radiative element;

a grounding point adjacent to the feeding point, for electrically connecting the first end of the radiative element to the ground plane, and a further radiative element having an elongated segment made of electrically conductive material, and a grounding segment electrically connecting the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section and the first section lie in axes substantially parallel to one another so that the placement of the second section relative to the first section together with the placement of the elongated segment of the further radiative element relative to the elongated strip provides resonance frequencies in the second frequency range.

7. The antenna module of claim 6, wherein the first frequency range is substantially between 750 MHz and 1000 MHz, and the second frequency range is substantially between 1700 MHz and 2200 MHz.

8. The antenna module of claim 7, wherein the length is substantially in the range of 60 mm to 80 mm and the support body is made substantially of plastic.

9. The antenna module of claim 6, wherein the support body has at least a first surface and a second surface, the first surface located on a first plane and a second surface located on a second plane different from the first plane, and wherein the first section of the elongate strip is located on the first surface of the support body and a second section of the elongated strip is located on a second surface of the support body.

10. The antenna module of claim 9, wherein the first surface is substantially perpendicular to the second surface.

11. The antenna module of claim 10, wherein the first surface and the second surface are separated by a curved surface.

12. The antenna module of claim 9, wherein the elongated strip further has an intermediate section disposed between the first section and the second section, and the intermediate section is located on the first surface of the support body.

13. The antenna module of claim 9, wherein the elongated strip further has an intermediate section disposed between the first section and the second section, and the intermediate section is located on the second surface of the support body.

14. The antenna module of claim 9, wherein the elongated strip further has an intermediate section disposed between the first section and the second section, the intermediate section having a first segment adjacent to the first section and a second segment adjacent to the second section, and wherein the first segment is located on the first surface and the second segment is located on the second surface.

15. The antenna module of claim 9, wherein the first surface is substantially parallel to the ground plane and the second surface is substantially perpendicular to the ground plane.

16. The antenna module of claim 6, further having another radiative element having an elongated segment made of electrically conductive material, and a grounding segment electrically connecting the elongated segment to the ground plane, wherein the elongated segment of said another radiative element is disposed between the radiative element and the further radiative element for providing further resonance frequencies in the second frequency range.

17. A communications device operable in a first frequency range and a second frequency range, the second frequency range having higher frequencies two to three times the frequencies in the first frequency range, said communications device comprising:

a housing;

a circuit board having a ground plane located in the housing; and an antenna module, the antenna module comprising:

a support body disposed on the circuit board, a radiative element made substantially of an elongated strip of electrically conductive material disposed on the support body, the strip having a first end and a second end, wherein the elongated strip has a first section adjacent to the first end and a second section adjacent to the second end electrically connected to the first section;

a feeding point electrically connected to the first end of the radiative element;

a grounding point adjacent to the feeding point, for electrically connecting the first end of the radiative element to the ground plane, and a further radiative element having an elongated segment made of electrically conductive material, and a grounding segment electrically connecting the elongated segment to the ground plane, wherein the elongated segment is disposed spaced from the radiative element and adjacent to one of the first and second sections of the elongated strip, and wherein the elongated strip has a length to provide resonance frequencies in the first frequency range, and the elongated strip is shaped such that the second section and the first section lie in axes substantially parallel to one another so that the placement of the second section relative to the first section together with the placement of the elongated segment of the further radiative element relative to the elongated strip provides resonance frequencies in the second frequency range.

18. The communications device of claim 17, wherein the first frequency range is substantially between 750 MHz and 1000 MHz, and the second frequency range is substantially between 1700 MHz and 2200 MHz.

19. The communications device of claim 18, wherein the length is substantially in the range of 60 mm to 80 mm and the support body is made substantially of plastic.

20. The communications device of claim 17, wherein the first section is located on a first plane and, the second section is located on a second plane different from the first plane.

21. The communications device of claim 17, comprising a mobile terminal.

* * * * *